US009983527B2

(12) United States Patent
Yamashita et al.

(10) Patent No.: US 9,983,527 B2
(45) Date of Patent: May 29, 2018

(54) FIXING DEVICE

(71) Applicant: CANON KABUSHIKI KAISHA, Tokyo (JP)

(72) Inventors: Kentaro Yamashita, Suntou-gun (JP); Tomonori Sato, Gotemba (JP); Yusuke Jota, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/283,686

(22) Filed: Oct. 3, 2016

(65) Prior Publication Data

US 2017/0102656 A1 Apr. 13, 2017

(30) Foreign Application Priority Data

Oct. 8, 2015 (JP) ..... 2015-200067

(51) Int. Cl.
*G03G 15/20* (2006.01)

(52) U.S. Cl.
CPC ..... *G03G 15/2089* (2013.01); *G03G 15/206* (2013.01); *G03G 15/2053* (2013.01); *G03G 2215/2035* (2013.01)

(58) Field of Classification Search
CPC ..... G03G 15/2089; G03G 15/206; G03G 15/2053; G03G 2215/2035
See application file for complete search history.

(56) References Cited

U.S. PATENT DOCUMENTS

2005/0254866 A1* 11/2005 Obata ..... G03G 15/2064 399/328
2008/0069611 A1* 3/2008 Obata ..... G03G 15/206 399/331
2010/0260524 A1* 10/2010 Hiraoka ..... G03G 15/2053 399/329
2014/0056627 A1 2/2014 Okabayashi et al.
2014/0294465 A1 10/2014 Hazeyama et al.
(Continued)

FOREIGN PATENT DOCUMENTS

JP 2008170596 A 7/2008
JP 2010230774 A 10/2010
JP 2011237831 A 11/2011
(Continued)

*Primary Examiner* — Carla Therrien
(74) *Attorney, Agent, or Firm* — Fitzpatrick, Cella, Harper & Scinto

(57) ABSTRACT

A fixing device includes a cylindrical rotatable heating member; a nip-forming member having a first surface and a second surface opposite from the first surface and contacting an inner surface of the rotatable heating member at the first surface; a supporting member having a supporting surface, contacting the second surface, for supporting the nip-forming member; and a pressing member for forming a nip in cooperation with the nip-forming member though the rotatable heating member. A recording material on which an image is formed is heated at the nip while being feed through the nip, and the image is fixed on the recording material. The supporting surface of the supporting member supports the second surface of the nip-forming member so that the nip-forming member is swingable relative to the supporting member about an axis substantially parallel with a rotational axis of the cylindrical rotatable heating member.

20 Claims, 10 Drawing Sheets

(56) References Cited

U.S. PATENT DOCUMENTS

| | | | | |
|---|---|---|---|---|
| 2014/0341622 | A1* | 11/2014 | Okabayashi ..... | G03G 15/2028 399/329 |
| 2016/0109834 | A1* | 4/2016 | Kadowaki ..... | G03G 15/2053 399/329 |

FOREIGN PATENT DOCUMENTS

| | | | |
|---|---|---|---|
| JP | 4961047 | B2 | 6/2012 |
| JP | 2014044257 | A | 3/2014 |
| JP | 2014199307 | A | 10/2014 |

* cited by examiner

| CROSS - SECTIONAL SHAPE | | X $10^3$ SHEETS [k PAGES] |
|---|---|---|
| COMP.EX.1 |  | 40 |
| EMB.1 |  | 122 |
| EXP.1 |  | 111 |
| EXP.2 |  | 125 |
| EXP.3 |  | 132 |
| EXP.4 |  | 104 |

| FRONT VIEW (y-DIRECTION) | | X $10^3$ SHEETS [k PAGES] |
|---|---|---|
| EMB.2 |   | 150 |
| EXP.5 |   | 147 |
| EXP.6 |   | 155 |
| EXP.7 |   | 152 |
| EXP.8 |   | 158 |

FIXING DEVICE

FIELD OF THE INVENTION AND RELATED ART

The present invention relates to a fixing device improved in durability.

In generation, a fixing device mountable in an image forming apparatus, such as a copying machine or a printer, of an electrophotographic type fixes a toner image that is carried on a recording material by heating the recording material while feeding the recording material through a nip formed by a rotatable heating member and a pressing roller press-contacted to the rotatable heating member.

Japanese Patent No. 4961047 discloses a fixing device of a heating roller type using a cylindrical fixing roller as a rotatable heating member in which a halogen heater is incorporated and using a pressing roller. In this heating roller type, in order to realize energy saving and shortening of first print output time, the fixing roller is required to be further decreased in thickness. Further, in order to uniformly apply uniform pressure to the fixing roller without flexing the fixing roller over a longitudinal direction of the fixing roller, it is required that an inside of the fixing roller is backed up by a solid sliding member.

However, due to position tolerance of the sliding member with respect to a recording material feeding direction or in the case in which alignment between the sliding member and the fixing roller with respect to the longitudinal direction (rotational axis direction) is deviated by a tolerance, one-side abutment (contact) generates between the sliding member and the fixing roller as the rotatable heating member at a fixing nip formed between the fixing roller and the pressing roller. As a result, there was a problem that abrasion of the sliding member and the fixing roller as the rotatable heating member is promoted and thus, durability of the fixing device is remarkably lowered.

SUMMARY OF THE INVENTION

According to an aspect of the present invention, there is provided a fixing device comprising: a cylindrical rotatable heating member; a nip-forming member having a first surface and a second surface opposite from the first surface and contacting an inner surface of the rotatable heating member at the first surface; a supporting member having a supporting surface, contacting the second surface, for supporting the nip-forming member; and a pressing member for forming a nip in cooperation with the nip-forming member though the rotatable heating member, wherein a recording material on which an image is formed is heated at the nip while being feed through the nip, and the image is fixed on the recording material, and wherein the supporting surface of the supporting member supports the second surface of the nip-forming member so that the nip-forming member is swingable relative to the supporting member about an axis substantially parallel with a rotational axis of the cylindrical rotatable heating member.

Further features of the present invention will become apparent from the following description of exemplary embodiments with reference to the attached drawings.

DESCRIPTION OF THE EMBODIMENTS

Embodiments of the present invention will be specifically described with reference to the drawings.

<First Embodiment>

Figure 1:
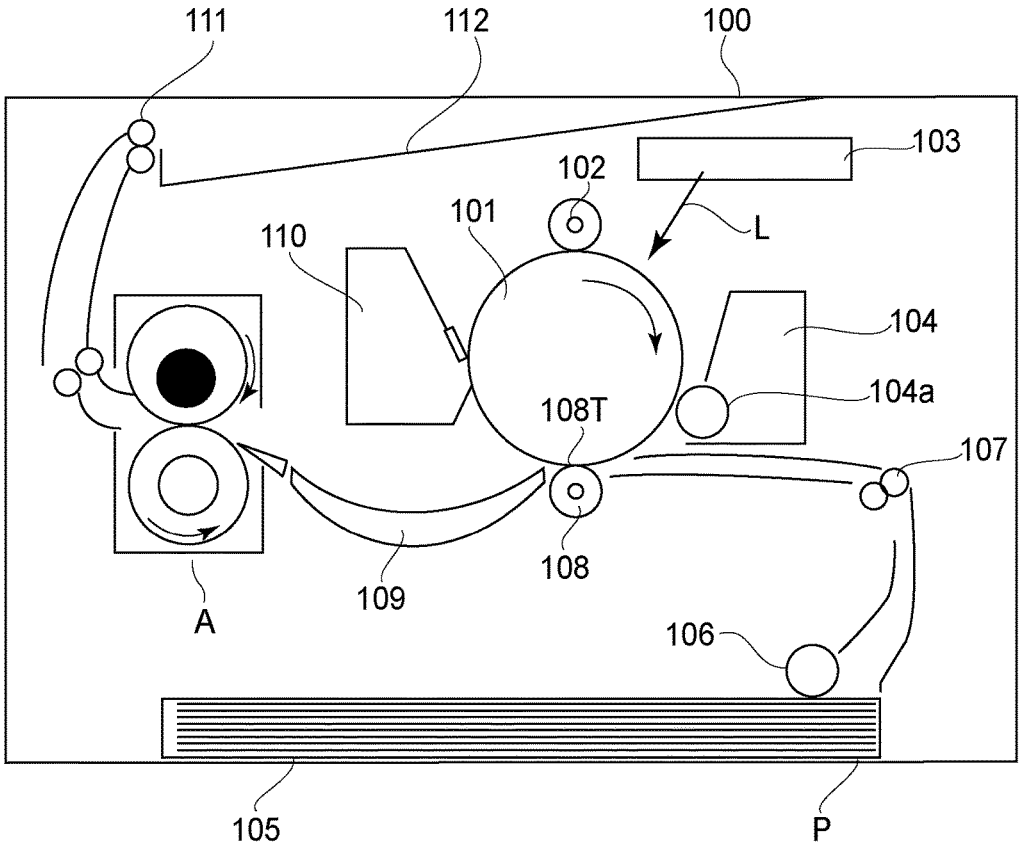
FIG. 1 is a schematic structural view of an image forming apparatus in which a fixing device according to an embodiment of the present invention is mounted.

FIG. 1 is a schematic structural view of an image forming apparatus 100 in which a fixing device according to an embodiment of the present invention is mounted. The image forming apparatus 100 is a laser beam printer of an electrophotographic type. A photosensitive drum 101 as an image bearing member is rotationally driven in the clockwise direction indicated by an arrow in FIG. 1 at a predetermined process speed. The photosensitive drum 101 is electrically charged uniformly to a predetermined polarity and a predetermined potential by a charging roller 102 in a rotation process thereof.

A laser beam scanner 103 as an image exposure means outputs laser light L ON/OFF-modulated correspondingly to a digital pixel signal inputted from an unshown external device such as a computer, so that a charged surface of the photosensitive drum 101 is subjected to scanning exposure to the laser light L. By this scanning exposure, electric charges of the surface of the photosensitive drum 101 at an exposed (light) portion are removed, so that an electrostatic latent image corresponding to image information is formed on the surface of the photosensitive drum 101. The electrostatic latent image on the surface of the photosensitive drum 101 is successively developed as a toner image which is a transferable image by supplying a developer (toner) from a developing roller 104*a* of a developing device 104 to the surface of the photosensitive drum 101.

In a sheet (paper) feeding cassette 105, sheets of a recording material P are stacked and accommodated. In general, the recording material P is a sheet-shaped member on which the toner image is to be formed and includes regular or irregular sheet-shaped members such as plain paper, thick paper, thin paper, a postcard, a seal, a resin material sheet, an OHP sheet and glossy paper, for example.

On the basis of a sheet (paper) feeding start signal, a sheet feeding roller 106 is driven, so that the sheets of the recording material P in the sheet feeding cassette 105 are separated and fed one by one. Then, the recording material P is introduced at predetermined timing through a registration roller pair 107 into a transfer portion 108T which is a contact nip between the photosensitive drum 101 and a transfer roller 108 rotated by the photosensitive drum 101 in contact with the photosensitive drum 101. That is, feeding of the recording material P is controlled by the registration roller pair 107 so that a leading end portion of the toner image on the photosensitive drum 101 and a leading end portion of the recording material P simultaneously reach the transfer portion 108T.

Thereafter, the recording material P is nipped and fed through the transfer portion 108T, and in a nip-feeding period, a transfer voltage (transfer bias) controlled in a predetermined manner is applied from an unshown transfer bias applying voltage source to the transfer roller 108. To the transfer roller 108, the transfer bias of a polarity opposite to a charge polarity of the toner is applied, so that the toner image is electrostatically transferred from the surface of the photosensitive drum 101 onto a surface of the recording material P at the transfer portion 108T. After the transfer of the toner image onto the surface of the recording material P, the recording material P is separated from the surface of the photosensitive drum 101 and passes through a feeding guide 109, and then is introduced into a fixing device (apparatus) A as a heating device (apparatus).

In the fixing device A, the toner image is subjected to a heat-fixing process. On the other hand, after the transfer of the toner image onto the surface of the recording material P, the surface of the photosensitive drum 101 is subjected to removal of a transfer residual toner, paper dust, and the like by a cleaning device 110, and thus is cleaned, so that the photosensitive drum 101 is subjected to image formation repetitively. The recording material P that has passed through the fixing device A is discharged onto a sheet discharge tray 112 through a sheet discharge opening 111.

(Fixing device)

Figure 2:
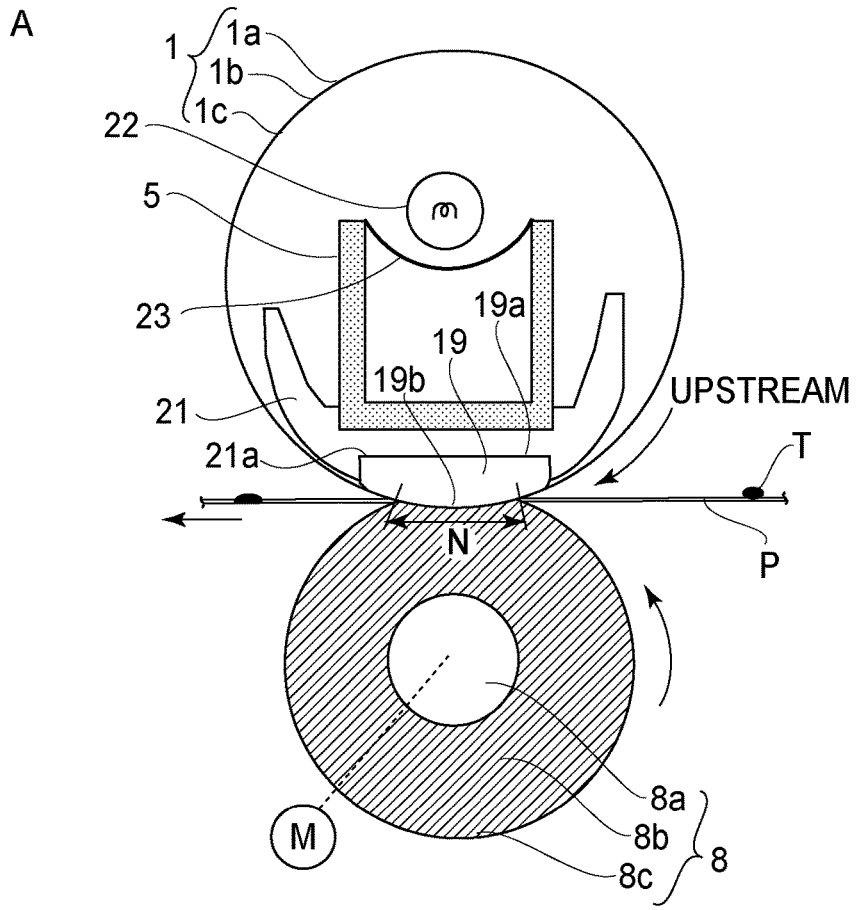
FIG. 2 is a sectional view of the fixing device according to a first embodiment with respect to a feeding direction.
Figure 3:
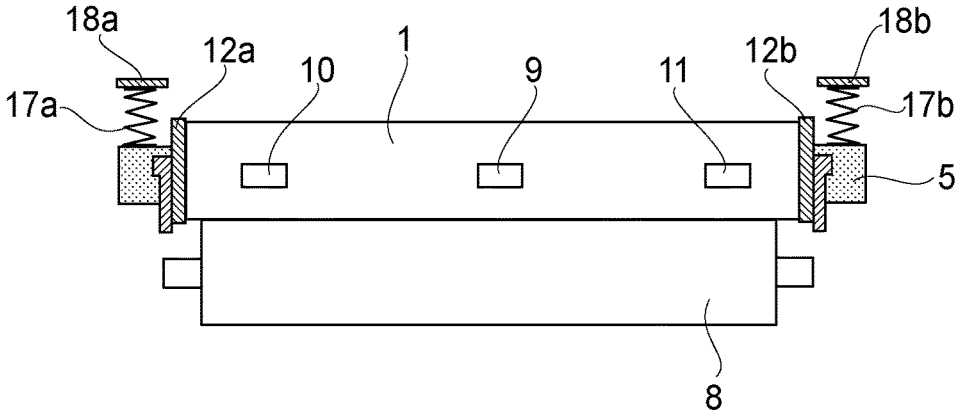
FIG. 3 is a front view of the fixing device according to the first embodiment with respect to an axial direction.

The fixing device A in this embodiment is a fixing device of a halogen heating type. FIG. 2 is a sectional view of the fixing device A with respect to a feeding direction in this embodiment, and FIG. 3 is a front view of the fixing device with respect to an axial direction. A pressing roller 8, as a pressing member, is prepared by coating a metal core 8*a* with a 3.5 mm-thick heat-resistant elastic layer 8*b* of a silicone rubber, a fluorine-containing rubber, a fluorine-containing resin material, or the like in a roller shape so as to be concentrically integral with the metal core 8*a* and then forming a 15-25 μm-thick parting layer 8*c* on the elastic layer 8*b*, and is 25 mm in diameter.

The elastic layer 8*b* may preferably be formed with a material having a good heat-resistant property, such as the silicone rubber, the fluorine-containing rubber, a fluorosilicone rubber or the like. The metal core 8*a* is rotatably held and disposed at end portions thereof between chassis side metal plates of the fixing device A through bearings.

Further, as shown in FIG. 3, pressing springs 17*a* and 17*b* are compressedly provided between an end portion of a pressing stay 5 and a device chassis-side spring receiving member 18*a* and between the other end portion of the pressing stay 5 and a device chassis-side spring receiving member 18*b*, respectively, so that a pressing-down force is caused to act on the pressing stay 5. In the fixing device A in this embodiment, a pressing force of about 100 N-about 250 N (about 10 kgf-about 25 kgf) in total pressure is applied. As a result, the sliding member 19 is press-contacted to the fixing roller 1 toward the pressing roller 8, so that a fixing nip N having a predetermined width is formed.

The sliding member (nip-forming member) 19 is constituted by a highly thermally conductive member, such as a pure aluminum (A105OP), and is inserted in the fixing roller 1 in order to prevent flexure of the fixing roller 1 as a cylindrical rotatable member. Further, a sliding surface of a surface layer of a sliding (plate) member 19 is formed as a 30-50 μm thick heat-resistant coating layer 20 of a fluorine-based material or a silicon-based material having a low friction coefficient.

The pressing roller 8 is rotationally driven by a driving means M in the counterclockwise direction indicated by an arrow in FIG. 2, so that a rotational force is exerted on the fixing roller 1 by a frictional force of the pressing roller 8 with an outer surface of the fixing roller 1. The sliding member 19 is held by a holder 21 as a holding member (supporting member) formed of a heat-resistant resin material such as PPS. Details of the sliding member 19 and the holder 21 will be described later.

Flange members 12*a* and 12*b* shown in FIG. 3 are externally engaged at left and right end portions with a roller guide 21 also functioning as the holder and perform the function of preventing lateral movement (shift) of the fixing roller 1 by receiving the end portions of the fixing roller 1 during the rotation of the fixing roller 1. As a material of the flange members 12*a* and 12*b*, a resin material, particularly a high heat-resistant resin material is preferred.

The fixing roller 1, as shown in FIG. 2, constitutes the cylindrical rotatable member having a composite structure including a base layer 1*a* of 10-50 mm in diameter, an elastic layer 1*b* laminated on an outer surface of the base layer 1*a*, and a parting layer 1*c* laminated on an outer surface of the elastic layer 1*b*. The base layer 1*a* is formed of metal, such as aluminum SUS or iron, and has a thickness of 500 μm or less (specifically 150-500 μm) which is thinner than that of a conventional base layer. Further, the elastic layer 1*b* is formed of a silicone rubber, a fluorine-containing rubber, or the like, and has a thickness of 200-800 μm. Further, the parting layer 1*c* is formed of a fluorine-containing resin material and has a thickness of 15-25 μm and a diameter of 30 mm.

Inside the fixing roller 1, a halogen heater 22 as a heating member is fixed to a side plate and by this halogen heater 22, the fixing roller 1 is internally heated. As a result, the recording material P passed through the fixing nip N is heated and a toner image T is fixed on the recording material P, and then the recording material P is separated by an unshown separation claw, so that the recording material P is discharged.

A reflecting member 23 is provided between the pressing stay 5 and the halogen heater 22 and is formed of a metallic material having a high melting point. By this placement of the reflecting member 23, light emitted (irradiated) from the halogen heater 22 toward the pressing stay 5 is reflected, so that it becomes possible to efficiently heat the fixing roller 1.

Temperature detection of the fixing device A is made by temperature detecting elements 9, 10 and 11 of a non-contact type which are provided at a central portion and end portions of the fixing roller 1 with respect to a rotational axis direction (longitudinal direction) of the fixing roller 1. Here, temperature control is effected on the basis of the temperature detected by the temperature detecting element 9 disposed at the central portion with respect to the rotational axis direction of the fixing roller 1, so that the fixing roller 1 is heated and a surface temperature of the fixing roller 1 is kept at a predetermined target temperature.

(Sliding Member and Holder)

Figure 4:
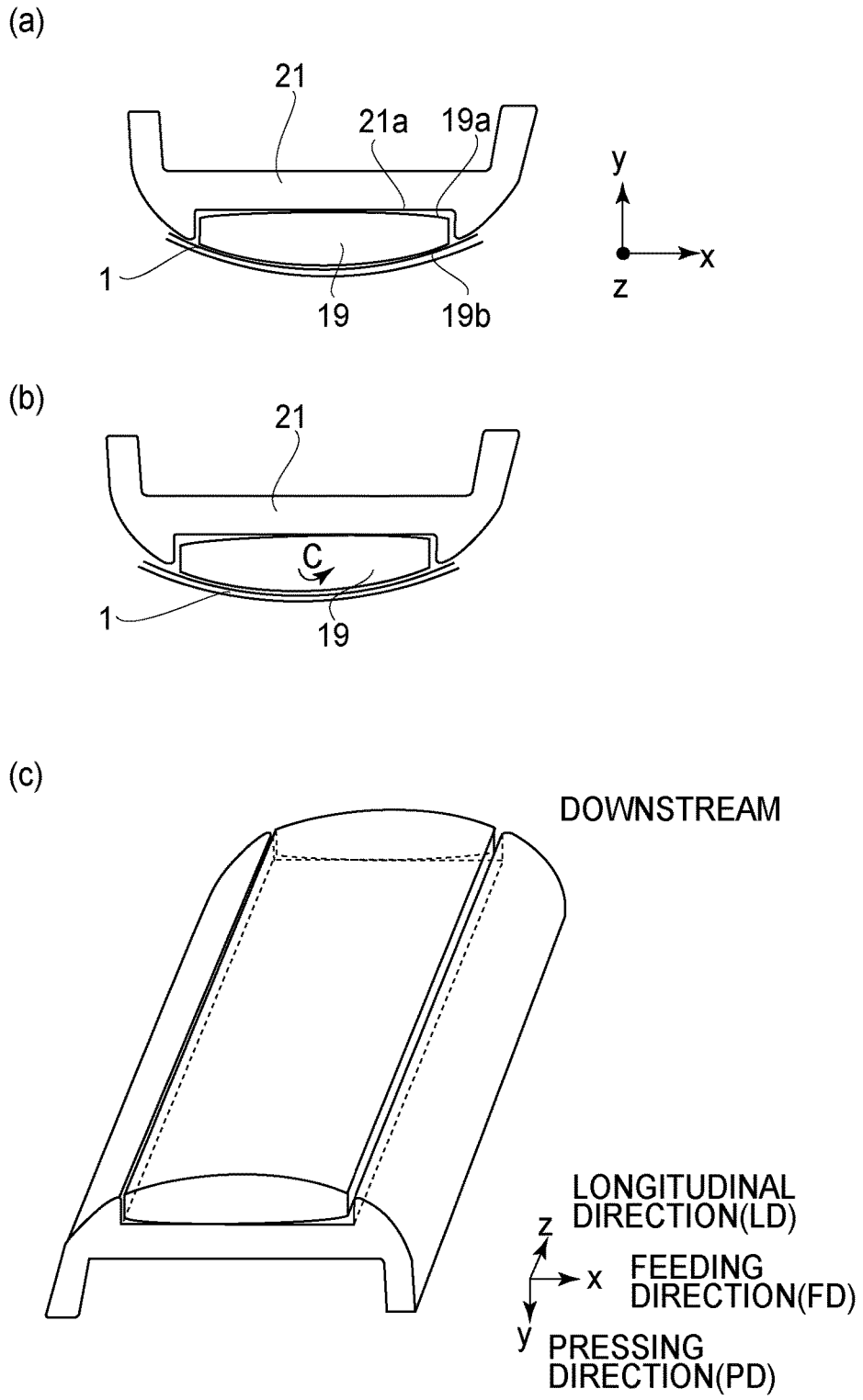
In FIG. 4, (a) and (b) are sectional views each showing a sliding member and a holder in the first embodiment, and (c) is a perspective view showing the sliding member and the holder.
Figure 5:
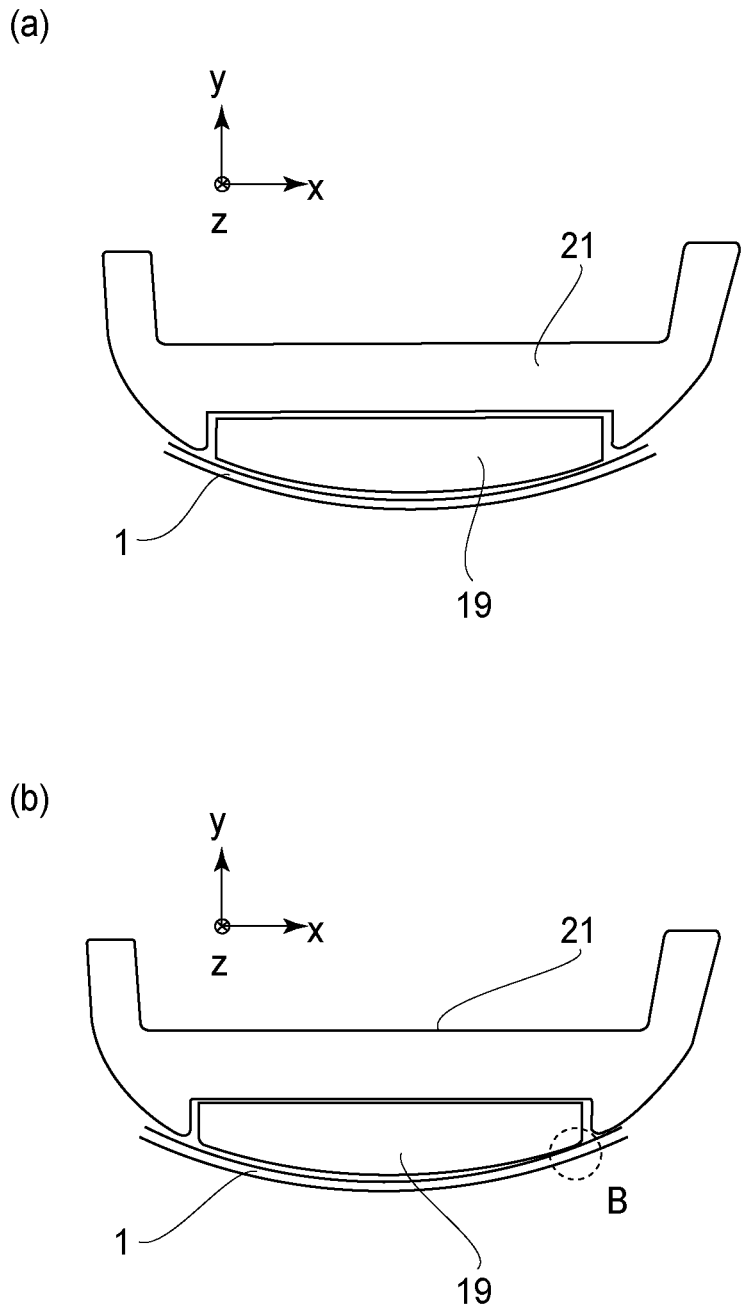
In FIG. 5, (a) and (b) are sectional views each showing a sliding member and a holder in Comparison Example 1.

FIG. 4 shows the sliding member and the holder in this embodiment (Embodiment 1), and FIG. 5 shows a sliding member and a holder in Comparison Example 1. The sliding members in this embodiment (Embodiment 1) and Comparison Example 1 have different shapes in a strict sense, but are represented by the same reference numeral 19 in the figures for convenience. In FIGS. 4 and 5, a z-direction is a longitudinal direction (first direction), an x-direction is a recording material feeding direction (second direction), and a y-direction is a pressing direction (up-down (vertical) direction in general). The fixing roller 1 is the rotatable member (cylindrical rotatable member) extending in the longitudinal direction (first direction).

In FIG. 4, (a) and (b) are sectional views of the sliding member 19 and the holder 21 with respect to a direction perpendicular to the longitudinal direction (first direction, z-direction), and (c) is a perspective view of the sliding member 19 and the holder 21.

In FIG. 4, in a cross-section perpendicular to the longitudinal direction (first direction, z-direction), a pressing surface (first surface) 19*b* for forming the fixing nip N of the fixing roller 1 by the sliding member 19 has a convex shape of 13.98 mm in radius of curvature R. That is, as seen in the longitudinal direction of the fixing roller 1, the pressing surface 19*b* of the sliding member 19 has a curved surface region which is convex with respect to the −y-direction (direction of approaching the pressing roller 8). On the other hand, a bearing surface (second surface) 19*a* of the sliding member 19, opposite from the pressing surface 19*b*, has a curved surface region which has a crown amount with respect to the +y-direction, and, in this embodiment, the crown amount of the curved surface region is 200 μm. That is, as seen in the longitudinal direction of the fixing roller 1, the bearing surface 19*a* of the sliding member 19 has the curved surface region which is convex with respect to the +y-direction (direction of being spaced from the pressing roller 8). Further, in the cross-section perpendicular to the longitudinal direction (first direction, z-direction), the bearing surface 19*a* of the sliding member 19 contacts a flat surface-shaped opposing surface (supporting surface) 21*a* of the holder 21 at a central portion with respect to the (recording material) feeding direction (x-direction).

On the other hand, in Comparison Example 1, as shown in a sectional view in (a) of FIG. 5, both of the bearing surface 19*a* of the sliding member 19 and the opposing surface 21*a* of the holder 21 contacting the bearing surface 19*a* have a flat surface shape.

(Comparison of effect)

Then, an abrasion amount of the coating layer 20 of the sliding member surface was evaluated when the recording materials P were passed through the fixing nip N at a process speed of 296 mm/sec in each of this embodiment (Embodiment 1) and Comparison Example 1. Electric power supplied to the halogen heater 22 was controlled so that the fixing roller temperature was kept at 170° C. which is the temperature detected by the temperature detecting element 9.

Figure 6:
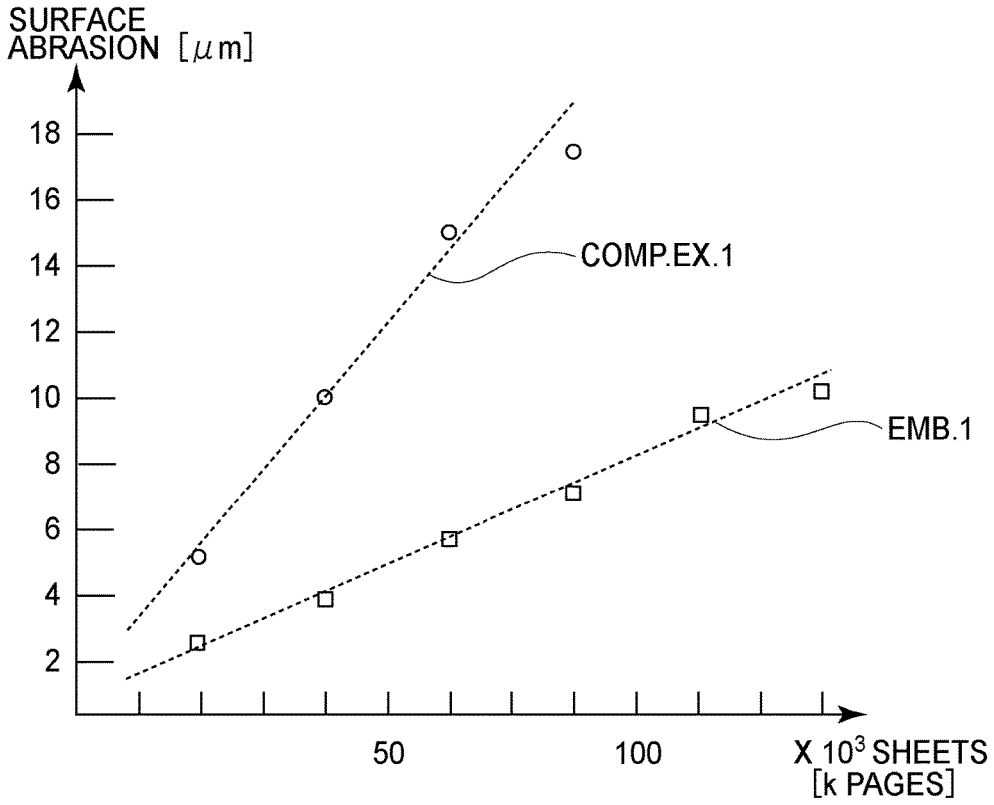
FIG. 6 is a graph showing an abrasion amount of a surface layer of the sliding member.

A fixing nip width in this embodiment (Embodiment 1) was 10 mm, and as the recording material P, a LTR-sized paper (216 mm×279 mm) ("Business 4200", manufactured by Xerox Corp. (basis weight: 75 g/m$^2$) was used. The recording material P was passed in a direction (sheet passing direction) so that a long side (297 mm) of the LTR-sized paper was parallel to the sheet passing direction, and sheets of the recording material P on which the toner image was formed (placed) with a print ratio of 5% were passed through the fixing nip N in an intermittent manner (durability test). Evaluation of the intermittent sheet passing in the durability test was made under a condition of idling the fixing roller 1 for 4 sec every 2 sheets. FIG. 6 shows a result of comparison of surface layer abrasion amounts of the sliding members 19 in this embodiment (Embodiment 1) and Comparison Example 1 at a position (portion) where the associated coating layers 20 were most abraded.

The reason why durability in this embodiment (Embodiment 1) is improved compared with Comparison Example 1 will be described. In FIG. 5, (b) shows a contact state between the sliding member 19 and the holder 21 in the case where positions of the sliding member 19, the holder 21 and the fixing roller 1 are deviated due to a tolerance with respect to the x-direction in Comparison Example 1. A center of an arc of the surface of the sliding member 19 and a center of an arc of the fixing roller 1 do not coincide with each other, and therefore at a portion B in (b) of FIG. 5, one-side abutment (contact) generates, so that abrasion is promoted.

On the other hand, in this embodiment (Embodiment 1), even in the case where the positions with respect to the feeding direction are deviated due to the tolerance, the bearing surface 19*a* of the sliding member 19 can be improved in durability by a crown shape of the sliding member 19. That is, in this embodiment (Embodiment 1), when the pressing force is applied to the pressing stay 5, a rotational force in an arrow C direction in (b) of FIG. 4 acts on the sliding member 19 so that the arcs of the fixing roller 1 and the sliding member 19 at the contact surface therebetween coincide with each other. For that reason, the one-side abutment as observed in Comparison Example 1 can be effectively suppressed and thus durability can be improved.

Figure 7:
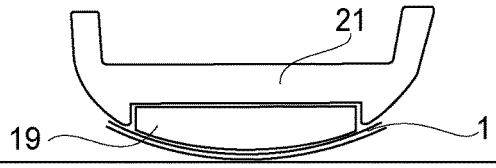
FIG. 7 is a schematic view showing a relationship between a cross-sectional shape and a durable sheet number in each of Comparison Example 1, the first embodiment, and Experiment Examples 1 to 4.
Figure 7:
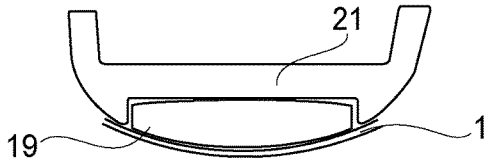
Figure 7:
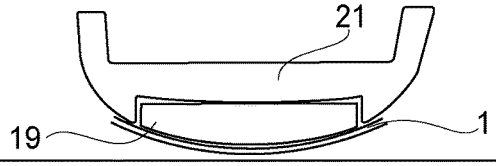
Figure 7:
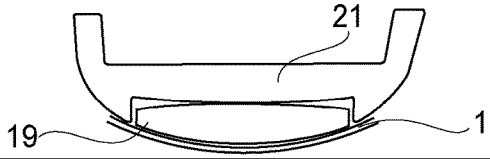
Figure 7:
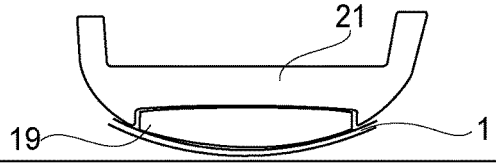
Figure 7:
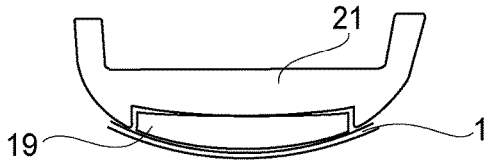
Figure 7:
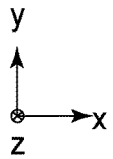

Experiment Examples 1 to 4 shown in FIG. 7 each shows a constitution in which at least one of the bearing surface 19*a* of the sliding member 19 and the opposing surface 21*a* of the holder 21 that contacts the sliding member 19 has a convex shape. Further, FIG. 7 shows a relationship between a cross-sectional shape and a durable sheet number until the abrasion amount of the coating layer 20 reaches 10 μm in each of Experiment Examples 1 to 4 together with those in Embodiment 1 and Comparison Example 1.

In Experiment Example 1, as seen in the longitudinal direction of the fixing roller 1, the bearing surface 19*a* of the sliding member 19 is a flat surface region, and the opposing surface 21*a* of the holder 21 is a curved surface region (200 μm crown shape) which is convex with respect to the −y-direction.

In Experiment Example 2, as seen in the longitudinal direction of the fixing roller 1, the bearing surface 19*a* of the sliding member 19 is a curved surface region (200 μm crown shape) which is convex with respect to the +y-direction, and the opposing surface 21*a* of the holder 21 is a curved surface region (200 μm crown shape) which is convex with respect to the −y-direction.

In Experiment Example 3, as seen in the longitudinal direction of the fixing roller 1, the bearing surface 19*a* of the sliding member 19 is a contact surface region (200 μm crown shape) which is convex with respect to the +y-direction, and the opposing surface 21*a* of the holder 21 is a curved surface region (150 μm crown shape) which is concave with respect to the +y-direction. A radius of curvature of the concavely curved surface region of the opposing surface 21*a* is larger than a radius of curvature of the convexly curved surface region of the bearing surface 19*a*.

In Experiment Example 4, as seen in the longitudinal direction of the fixing roller 1, the bearing surface 19*a* of the sliding member 19 is a curved surface region (150 Tim crown shape) which is concave with respect to the −y-direction, and the opposing surface 21*a* of the holder 21 is a curved surface region (200 μm crown shape) which is concave with respect to the +y-direction. A radius of curvature of the concavely curved surface region of the opposing surface 21*a* is smaller than a radius of curvature of the concavely curved surface region of the bearing surface 19*a*.

Similarly as in this embodiment (Embodiment 1), in Experiment Examples 1 to 4, at least one of the bearing surface of the sliding member 19 and the contact surface of the holder 21 with the sliding member 19 has the convex shape. For this reason, when the pressing force is applied to the pressing stay 5, the rotational force acts on the sliding (plate) member 19 so that the arcs of the fixing roller 1 and the sliding member 19 at the contact surface coincide with each other. As a result, the one-side abutment (contact) of the coating layer 20 can be effectively suppressed, so that it becomes possible to improve the durability.

<Second Embodiment>

A second embodiment according to the present invention will be described. Constitutions excluding the sliding member 19 and the holder 21 are similar to those in the first embodiment (Embodiment 1) and therefore will be omitted from description.

(Sliding member and holder)

In this embodiment, similarly as in the first embodiment (Embodiment 1), at least one of the bearing surface 19*a* of the sliding member 19 and the opposing surface 21*a* of the holding member (holder) 21 has a convex shape in a cross-section perpendicular to the longitudinal direction (first direction). Specifically, the bearing surface 19*a* of the sliding member 19 has the convex shape with respect to the pressing direction (+y-direction) and is 200 μm in crown amount. Further, in the cross-section perpendicular to the longitudinal direction (first direction, z-direction), the bearing surface 19*a* of the sliding member 19 contacts the flat surface-shaped opposing surface 21*a* of the holder 21 at a central portion with respect to the feeding direction (x-direction).

Further, in this embodiment, with respect to the longitudinal direction (first direction), at least one of a first surface of the sliding member 19 in a downstream side with respect to the feeding direction (second direction) and a second surface of the holding member 21 with respect to the feeding direction has the convex shape in a cross-section including the first direction and the second direction.

Figure 8:
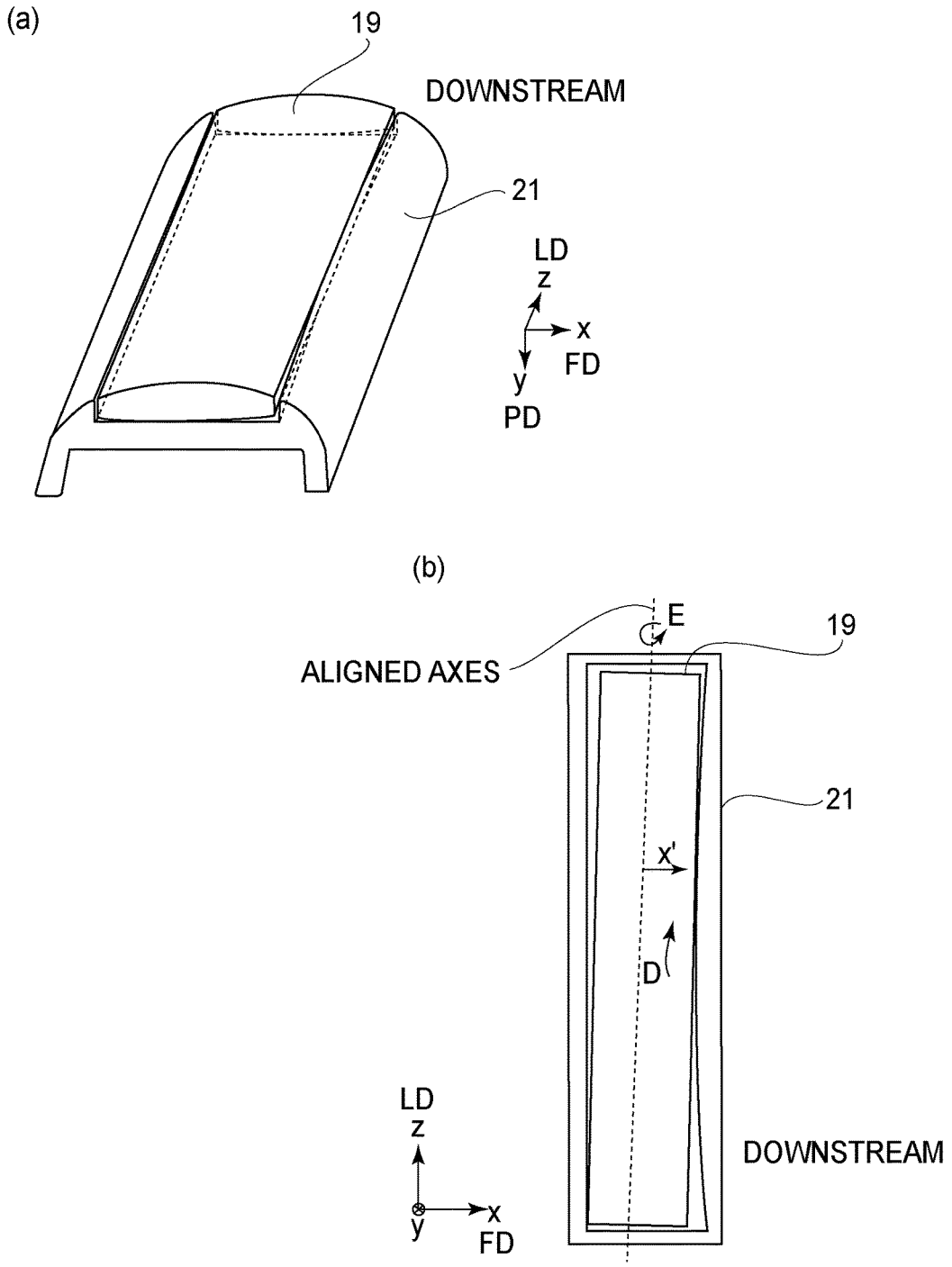
In FIG. 8, (a) is a perspective view of a fixing device according to a second embodiment, and (b) is a front view of the fixing device according to the second embodiment.

In FIG. 8, (a) is a perspective view of the sliding member 19 and the holder 21 in this embodiment, and (b) is a schematic view of the sliding member 19 and the holder 21 as seen in the y-direction. A sectional view of the sliding member 19 and the holder 21 as seen in the z-direction is similar to that in the first embodiment (Embodiment 1). On the other hand, an abutting surface (first surface) of the sliding member 19 in a downstream side with respect to the recording material feeding direction (x-direction) is a flat surface, and a contact surface (second surface) of the holder 21 that contacts the sliding member 19 has a convex shape and 200 μm in crown amount respect to the −x-direction.

An effect of this embodiment will be described later in comparison with the third embodiment (Embodiment 3) described below.

<Third Embodiment>

Figure 9:
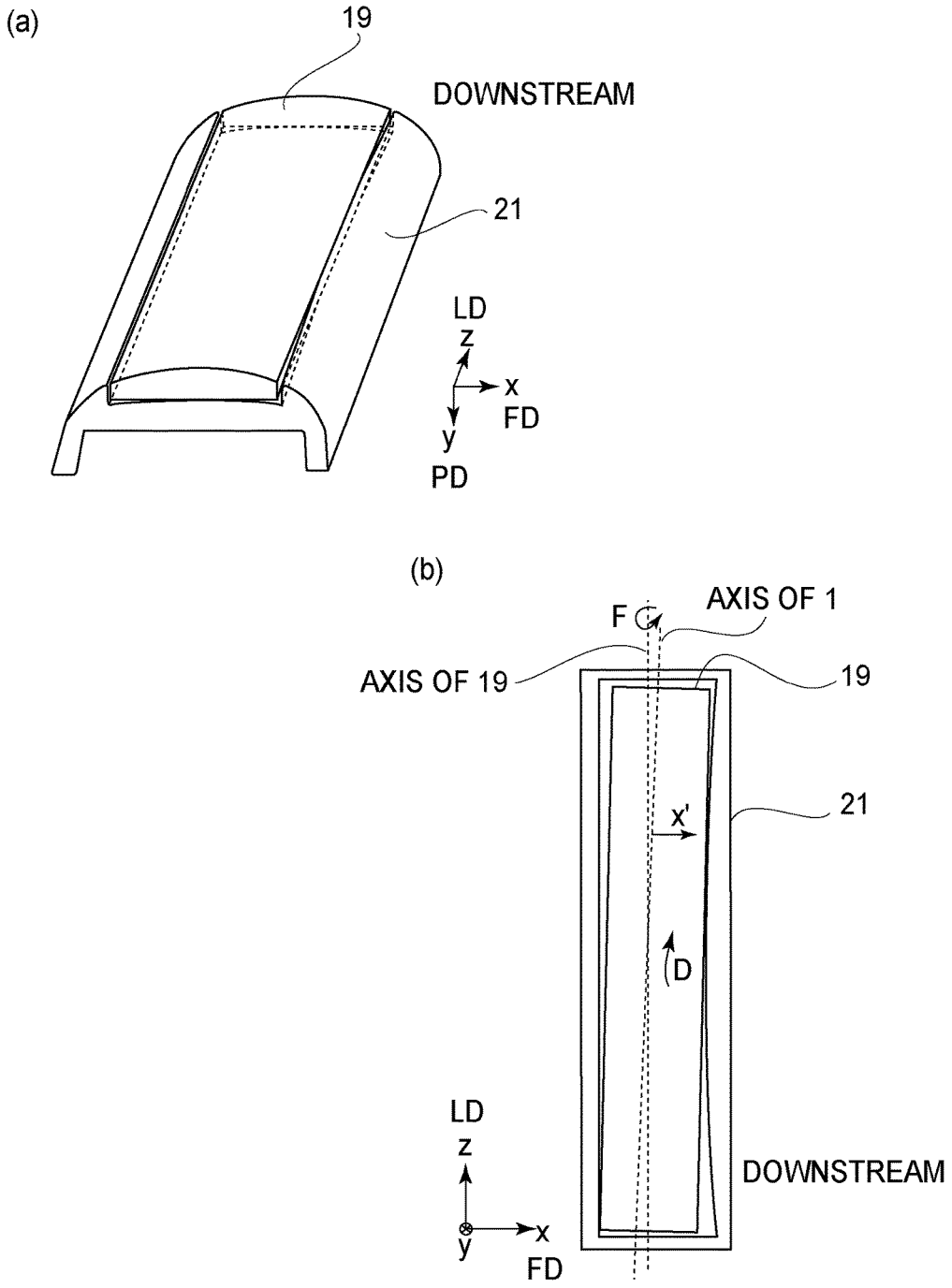
In FIG. 9, (a) is a perspective view of a fixing device according to a third embodiment, and (b) is a front view of the fixing device according to the third embodiment.

Compared with the second embodiment (Embodiment 2), in the third embodiment (Embodiment 3), as shown in FIG. 9, the bearing surface 19*a* of the sliding member 19 is a flat surface, and the opposing surface of the holder 21 opposing the sliding member 19 has a convex shape and is 200 μm in crown shape with respect to the −y-direction. The downstream surfaces of the sliding member 19 and the holder 21 with respect to the x-direction are similar to those in the second (Embodiment 2).

(Comparison of effect between Second and Third Embodiments)

Figure 10:
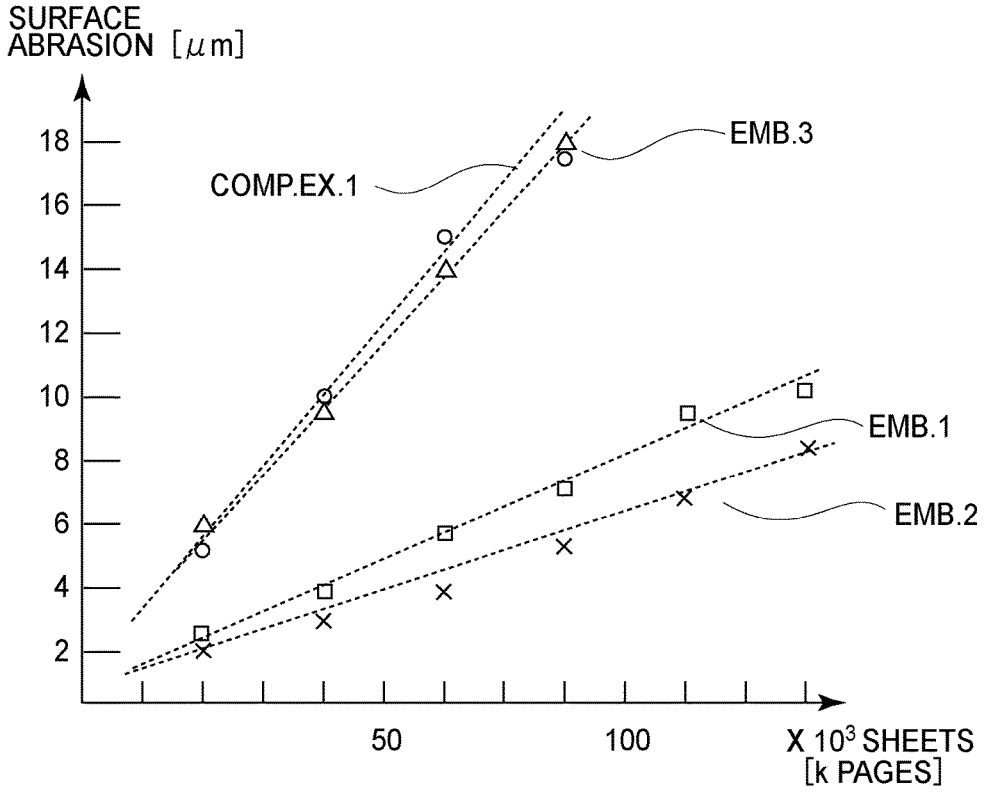
FIG. 10 is a graph showing an abrasion amount of surface layer of a sliding member.

A durability test was conducted under the same condition as that in the first embodiment (Embodiment 1). FIG. 10 shows a result of comparison of abrasion amount at a most abraded position of the coating layer 20 between the second embodiment (Embodiment 2) and the third embodiment (Embodiment 3) together with that of the first embodiment and Comparison Example 1. The reason why durability in the second embodiment (Embodiment 2) is improved compared with the third embodiment (Embodiment 3) will be described below.

In FIG. 9, (b) shows a rotation axis F of the sliding member 19 and a center axis of the cylinder of the fixing roller 1 in the case where angles of the sliding member 19 and the fixing roller 1 are deviated due to a tolerance. The downstream surface of the holder 21 with respect to the y-direction has a crown shape, and therefore, a rotational force D ((b) of FIG. 9) acts so that the angles of the sliding member 19 and the fixing roller 1 are corrected.

However, the rotation axis F and the center axis of the cylinder of the fixing roller 1 do not coincide with each other, and therefore, a positional tolerance between the sliding member 19 and the fixing roller 1 with respect to the feeding direction (hereinafter referred to as x'-direction) of the recording material P when a tolerance angle is formed as shown in (b) of FIG. 9 cannot be corrected. As a result, the one-side abutment between the sliding member 19 and the fixing roller 1 cannot be sufficiently suppressed to a degree of the second embodiment (Embodiment 2) described below.

On the other hand, in the second embodiment (Embodiment 2), in the case in which the angles of the sliding member 19 and the fixing roller 1 are deviated due to the tolerance, not only the rotational force D acts similarly as in the third embodiment (Embodiment 3) but also a rotational force E acts on the sliding member 19 so that the rotation axis of the sliding member 19 coincides with the center axis of the cylinder of the fixing roller 1. This is because the bearing surface 19*a* of the sliding member 19 has the crown shape with respect to the +y-direction, and therefore, by virtue of having this crown shape, also allows for correction of a positional tolerance between the sliding member 19 and the fixing roller 1. As a result, the one-side abutment due to misalignment and positional deviation with respect to the feeding direction between the sliding member 19 and the fixing roller 1 is effectively suppressed, so that the durability can be improved.

Figure 11:
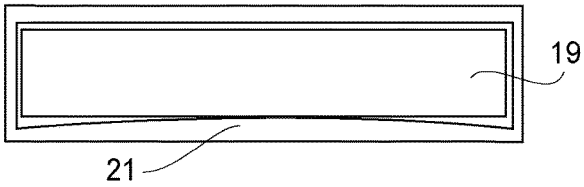
FIG. 11 is a schematic view showing a relationship between a cross-sectional shape and a durable sheet number in each of the second embodiment and Experiment Examples 5 to 8.
Figure 11:
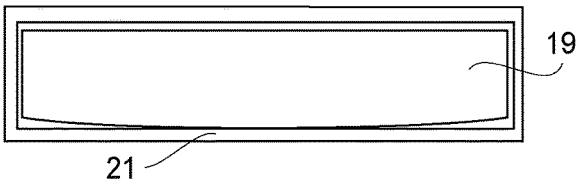
Figure 11:
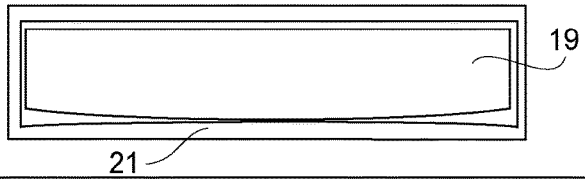
Figure 11:
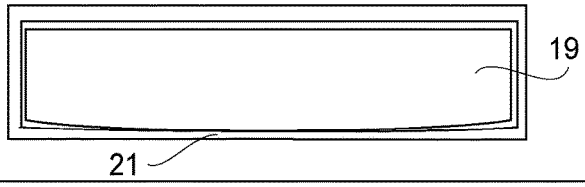
Figure 11:
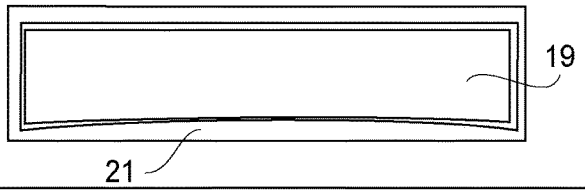
Figure 11:
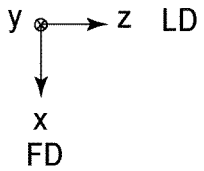

In Experiment Examples 5 to 8, shown in FIG. 11, cross-sectional shapes of the sliding member 19 and the fixing roller 1 perpendicular to the z-direction (first direction) are similar to the cross-sectional shapes in the first embodiment (Embodiment 1). That is, as shown in FIG. 4, the bearing surface 19*a* of the sliding member 19 has the convex shape with respect to the pressing direction (+y-direction) and is 200 μm in crown amount. Further, in the cross-section perpendicular to the longitudinal direction (first direction, z-direction), the bearing surface 19*a* of the sliding member 19 contacts the flat surface-shaped opposing surface 21*a* of the holder 21 at a central portion with respect to the feeding direction (x-direction).

In FIG. 11, in each of Experiment Examples 5 to 8, with respect to the longitudinal direction (first direction), at least one of a first surface of the sliding member 19 in a downstream side with respect to the feeding direction (second direction) and a second surface of the holding member 21 with respect to the feeding direction has the convex shape in a cross-section including the first direction and the second direction. Further, FIG. 11 also shows a relationship between the cross-sectional shape and the durable sheet number until the abrasion amount of the coating layer 20 reaches 10 μm.

In Experiment Example 5, the downstream abutment surface of the sliding member 19 has a crown shape of 200 μm with respect to the +x-direction, and the contact surface of the holder 21 that contacts the sliding member 19 is the flat surface. In Experiment Example 6, the downstream abutment surface of the sliding member 19 has a crown shape of 150 μm with respect to the +x-direction, and the contact surface of the holder 21 that contacts the sliding member 19 has a crown shape of 200 μm with respect to the −x-direction.

In Experiment Example 7, the downstream abutment surface of the sliding member 19 has a crown shape of 200 μm with respect to the +x-direction, and the contact surface of the holder 21 that contacts the sliding member 19 has a crown shape of 150 μm with respect to the +x-direction. In Experiment Example 8, the downstream abutment surface of the sliding member 19 has a crown shape of 150 μm with respect to the +x-direction, and the contact surface of the holder 21 that contacts the sliding member 19 has a crown shape of 200 μm with respect to the −x-direction.

Similarly as in the second embodiment (Embodiment 2), in Experiment Examples 5 to 8, the bearing surface of the sliding member 19 has the crown shape with respect to the +y-direction, and the contact surface of the holder 21 that contacts the sliding member 19 may be the flat surface. In addition, at least one of the downstream abutment surface of the sliding member 19 and the contact surface of the holder 21 that contacts the sliding member 19 has the convex shape. For this reason, the abrasion can be effectively suppressed by correcting not only the deviation of the positional tolerance with respect to the x'-direction but also the angle in the case where the angles of the center axis of the fixing roller 1 and the center axis of the sliding member 21 are deviated from each other. As a result, the one-side abutment of the coating layer 20 is effectively suppressed, so that the durability can be improved.

(Modified Embodiments)

In the above-described embodiments, preferred embodiments of the present invention were described but the present invention is not limited thereto but can also be variously modified within the scope of the present invention.

(Modified Embodiment 1)

The shapes of the sliding members 19 and the holders 21 described in the first and second embodiments and Experiment Examples 1 to 8 are not limited to those described above. When the positions and angles of the sliding member 19 and the fixing roller 1 with respect to the x'-direction can be corrected, the shapes are not limited to the crown shapes but may also be various concave-convex (uneven) shapes. That is, the number of contact positions is not limited to one but may also be two or more.

(Modified Embodiment 2)

In first embodiment (Embodiment 1) and the second embodiment (Embodiment 2), the halogen heater was used as the heating source, but the type of the heating source is not limited to the type of the halogen heater, and may also be other internal or external heating type using a ceramic heater, an electromagnetic induction coil, and the like.

(Modified Embodiment 3)

In the above-described embodiments, the fixing device for fixing the unfixed toner image on the sheet was described as an example, but the present invention is not limited thereto. The present invention is similarly applicable to a device for heating and pressing a toner image temporarily fixed on a sheet in order to improve glossiness of an image (also in this case, the device is referred to as the fixing device).

(Modified Embodiment 4)

In the above-described embodiments, the pressing roller was described as an opposing member for forming the nip in cooperation with the fixing roller, but the present invention is not limited thereto. The present invention is also applicable to a fixed flat plate-shaped pressing pad as the opposing member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-200067 filed on Oct. 8, 2015, which is hereby incorporated by reference herein in its entirety.

What is claimed is:

1. A fixing device comprising:

a cylindrical rotatable heating member having an inner surface;

a nip-forming member having a first surface that contacts the inner surface of said cylindrical rotatable heating member, and a second surface opposite to the first surface;

a supporting member having a supporting surface that contacts the second surface of said nip-forming member, for supporting said nip-forming member; and a pressing member for forming a nip in cooperation with said nip-forming member though said cylindrical rotatable heating member, wherein a recording material on which an image is formed is heated at the nip while being fed through the nip, and the image is fixed on the recording material, and wherein the supporting surface of said supporting member supports the second surface of said nip-forming member so that said nip-forming member is swingable relative to said supporting member about an axis substantially parallel to a rotational axis of said cylindrical rotatable heating member.

2. The fixing device according to claim 1, wherein the first surface of said nip-forming member has a convexly curved shape which is convex toward said pressing member as seen in a longitudinal direction of said cylindrical rotatable heating member.

3. The fixing device according to claim 1, wherein the second surface of said nip-forming member has a convexly curved surface region that is convex with respect to a direction in which said nip-forming member is spaced from said pressing member, as seen in a longitudinal direction of said cylindrical rotatable heating member, and the supporting surface of said supporting member has one of a flat surface region and a convexly curved surface region that is convex toward said pressing member, as seen in the longitudinal direction of said cylindrical rotatable heating member.

4. The fixing device according to claim 1, wherein the second surface of said nip-forming member has a flat surface region, as seen in a longitudinal direction of said cylindrical rotatable heating member, and the supporting surface of said supporting member has a convexly curved surface region that is convex toward said pressing member, as seen in the longitudinal direction of said cylindrical rotatable heating member.

5. The fixing device according to claim 1, wherein the second surface of said nip-forming member has a convexly curved surface region that is convex with respect to a direction in which said nip-forming member is spaced from said pressing member, as seen in a longitudinal direction of said cylindrical rotatable heating member, and the supporting surface of said supporting member has a concavely curved surface region that is concave from said pressing member, as seen in the longitudinal direction of said cylindrical rotatable heating member, and wherein a radius of curvature of the supporting surface in the concavely curved surface region is larger than a radius of curvature of the second surface in the convexly curved surface region.

6. The fixing device according to claim 1, wherein the second surface of said nip-forming member has a concavely curved surface region that is concave toward said pressing member, as seen in a longitudinal direction of said cylindrical rotatable heating member, and the supporting surface of said supporting member has a convexly curved surface region that is convex toward said pressing member, as seen in the longitudinal direction of said cylindrical rotatable heating member, and wherein a radius of curvature of the supporting surface in the convexly curved surface region is smaller than a radius of curvature of the second surface in the concavely curved surface region.

7. The fixing device according to claim 1, wherein said nip-forming member is swingable relative to said supporting member about an axis that is perpendicular to both of a recording material conveying direction and to a longitudinal direction of said cylindrical rotatable heating member.

8. The fixing device according to claim 1, wherein said supporting member has an opposing surface opposing a downstream end surface of said nip-forming member with respect to a recording material conveying direction, and wherein the opposing surface has a convexly curved shape toward an upstream side of the recording material conveying direction.

9. A fixing device comprising:

a cylindrical rotatable heating member having an inner surface;

a nip-forming member having a first surface that contacts the inner surface of said cylindrical rotatable heating member, and a second surface opposite to the first surface;

a supporting member having a supporting surface that contacts the second surface of said nip-forming member, for supporting said nip-forming member; and a pressing member for forming a nip in cooperation with said nip-forming member though said cylindrical rotatable heating member, wherein a recording material on which an image is formed is heated at the nip while being fed through the nip, and the image is fixed on the recording material, wherein the second surface of said nip-forming member has a convexly curved surface region that is convex with respect to a direction in which said nip-forming member is spaced from said pressing member, as seen in a longitudinal direction of said cylindrical rotatable heating member, and the supporting surface of said supporting member has one of a flat surface region and a convexly curved surface region that is convex toward said pressing member, as seen in the longitudinal direction of said cylindrical rotatable heating member, and wherein the first surface of said nip-forming member has a convexly curved shape that is convex toward said pressing member, as seen in the longitudinal direction of said cylindrical rotatable heating member.

10. The fixing device according to claim 9, wherein said nip-forming member is swingable relative to said supporting member about an axis that is perpendicular to both of a recording material conveying direction and to the longitudinal direction of said cylindrical rotatable heating member.

11. The fixing device according to claim 9, wherein said supporting member has an opposing surface opposing a downstream end surface of said nip-forming member with respect to a recording material conveying direction, and wherein the opposing surface has a convexly curved shape toward an upstream side of the recording material conveying direction.

12. A fixing device comprising:

a cylindrical rotatable heating member having an inner surface;

a nip-forming member having a first surface that contacts the inner surface of said cylindrical rotatable heating member, and a second surface opposite to the first surface;

a supporting member having a supporting surface that contacts the second surface of said nip-forming member, for supporting said nip-forming member; and a pressing member for forming a nip in cooperation with said nip-forming member though said cylindrical rotatable heating member, wherein a recording material on which an image is formed is heated at the nip while being fed through the nip, and the image is fixed on the recording material, wherein the second surface of said nip-forming member has a flat surface region, as seen in a longitudinal direction of said cylindrical rotatable heating member, and the supporting surface of said supporting member has a convexly curved surface region that is convex toward said pressing member, as seen in the longitudinal direction of said cylindrical rotatable heating member, and wherein the first surface of said nip-forming member has a convexly curved shape that is convex toward said pressing member, as seen in the longitudinal direction of said cylindrical rotatable heating member.

13. The fixing device according to claim 12, wherein said nip-forming member is swingable relative to said supporting member about an axis that is perpendicular to both of a recording material conveying direction and to the longitudinal direction of said cylindrical rotatable heating member.

14. The fixing device according to claim 12, wherein said supporting member has an opposing surface opposing a downstream end surface of said nip-forming member with respect to a recording material conveying direction, and wherein the opposing surface has a convexly curved shape toward an upstream side of the recording material conveying direction.

15. A fixing device comprising:

a cylindrical rotatable heating member having an inner surface;

a nip-forming member having a first surface that contacts the inner surface of said cylindrical rotatable heating member, and a second surface opposite to the first surface;

a supporting member having a supporting surface that contacts the second surface of said nip-forming member, for supporting said nip-forming member; and a pressing member for forming a nip in cooperation with said nip-forming member though said cylindrical rotatable heating member, wherein a recording material on which an image is formed is heated at the nip while being fed through the nip, and the image is fixed on the recording material, wherein the second surface of said nip-forming member has a convexly curved surface region that is convex with respect to a direction in which said nip-forming member is spaced from said pressing member, as seen in a longitudinal direction of said cylindrical rotatable heating member, and the supporting surface of said supporting member has a concavely curved surface region that is concave from said pressing member, as seen in the longitudinal direction of said cylindrical rotatable heating member, wherein a radius of curvature of the supporting surface in the concavely curved surface region is larger than a radius of curvature of the second surface in the convexly curved surface region, and wherein the first surface of said nip-forming member has a convexly curved shape that is convex toward said pressing member as seen in the longitudinal direction of said cylindrical rotatable heating member.

16. The fixing device according to claim 15, wherein said nip-forming member is swingable relative to said supporting member about an axis that is perpendicular to both of a recording material conveying direction and to the longitudinal direction of said cylindrical rotatable heating member.

17. The fixing device according to claim 15, wherein said supporting member has an opposing surface opposing a downstream end surface of said nip-forming member with respect to a recording material conveying direction, and wherein the opposing surface has a convexly curved shape toward an upstream side of the recording material conveying direction.

18. A fixing device comprising:

a cylindrical rotatable heating member having an inner surface;

a nip-forming member having a first surface that contacts the inner surface of said cylindrical rotatable heating member, and a second surface opposite to the first surface;

a supporting member having a supporting surface that contacts the second surface of said nip-forming member, for supporting said nip-forming member; and a pressing member for forming a nip in cooperation with said nip-forming member though said cylindrical rotatable heating member, wherein a recording material on which an image is formed is heated at the nip while being fed through the nip, and the image is fixed on the recording material, wherein the second surface of said nip-forming member has a concavely curved surface region that is concave toward said pressing member, as seen in a longitudinal direction of said cylindrical rotatable heating member, and the supporting surface of said supporting member has a convexly curved surface region that is convex toward said pressing member, as seen in the longitudinal direction of said cylindrical rotatable heating member, wherein a radius of curvature of the supporting surface in the convexly curved surface region is smaller than a radius of curvature of the second surface in the concavely curved surface region, and wherein the first surface of said nip-forming member has a convexly curved shape that is convex toward said pressing member as seen in the longitudinal direction of said cylindrical rotatable heating member.

19. The fixing device according to claim 18, wherein said nip-forming member is swingable relative to said supporting member about an axis that is perpendicular to both of a recording material conveying direction and to the longitudinal direction of said cylindrical rotatable heating member.

20. The fixing device according to claim 18, wherein said supporting member has an opposing surface opposing a downstream end surface of said nip-forming member with respect to a recording material conveying direction, and wherein the opposing surface has a convexly curved shape toward an upstream side of the recording material conveying direction.

* * * * *